US010865093B2

(12) United States Patent
Yang

(10) Patent No.: US 10,865,093 B2
(45) Date of Patent: Dec. 15, 2020

(54) METHOD AND APPARATUS FOR A BEVERAGE DISPENSING SYSTEM

(71) Applicant: Lancer Corporation, San Antonio, TX (US)

(72) Inventor: Jun Yang, San Antonio, TX (US)

(73) Assignee: Lancer Corporation, San Antonio, TX (US)

( * ) Notice: Subject to any disclaimer, the term of this patent is extended or adjusted under 35 U.S.C. 154(b) by 138 days.

(21) Appl. No.: 15/983,293

(22) Filed: May 18, 2018

(65) Prior Publication Data

US 2019/0062140 A1 Feb. 28, 2019

Related U.S. Application Data

(60) Provisional application No. 62/551,611, filed on Aug. 29, 2017.

(51) Int. Cl.
*B67D 1/08* (2006.01)
*F25D 31/00* (2006.01)
(Continued)

(52) U.S. Cl.
CPC ..... *B67D 1/0867* (2013.01); *B65D 47/00* (2013.01); *B67D 1/0858* (2013.01);
(Continued)

(58) Field of Classification Search
CPC .... B67D 1/0867; B65D 47/00; B65D 1/0858; B65D 1/0864; F25D 17/06; F25D 31/006
See application file for complete search history.

(56) References Cited

U.S. PATENT DOCUMENTS 5,974,824 A 11/1999 Galockin et al.
6,182,453 B1 2/2001 Forsberg
(Continued)

FOREIGN PATENT DOCUMENTS

CN 206113504 U 4/2017
EP 2822891 B1 7/2017

OTHER PUBLICATIONS

Budweiser Direct Draw Beer Dispensing Cart.
(Continued)

*Primary Examiner* — Gordon A Jones
(74) *Attorney, Agent, or Firm* — Christopher L. Makay

(57) ABSTRACT

A beverage dispensing system includes a cabinet with a dispensing station. The cabinet includes therein a refrigeration system, a cooling fluid system, and a refrigerated compartment having therein a cooling system and a beverage source coupled with the dispensing station. The cooling fluid system circulates a cooling fluid through the refrigeration system such that the refrigeration system cools the cooling fluid. The cooling fluid system further normally circulates the cooling fluid through the dispensing station to cool beverage therein. The cooling fluid system directs the cooling fluid from the dispensing station to the cooling system when necessary to cool the refrigerated compartment. A beverage fluid system resides in the cooling fluid system between the beverage source and the dispensing station such that the cooling fluid system cools beverage flowing through the beverage fluid system prior to delivery of beverage to the dispensing station for dispensing therefrom.

9 Claims, 5 Drawing Sheets

(51) Int. Cl.
*F25D 17/06* (2006.01)
*B65D 47/00* (2006.01)

(52) U.S. Cl.
CPC ..... *B67D 1/0864* (2013.01); *F25D 17/06* (2013.01); *F25D 31/006* (2013.01); *B67D 2210/00104* (2013.01); *B67D 2210/00133* (2013.01); *F25D 2331/802* (2013.01); *F25D 2700/121* (2013.01)

(56) References Cited

U.S. PATENT DOCUMENTS 6,609,391 B2 * 8/2003 Davis ..... B67D 1/0012 222/146.6
7,516,623 B2 4/2009 Hall, Sr. et al.
7,743,624 B2 * 6/2010 Schneller ..... B67D 1/0867 222/146.6
8,011,190 B2 * 9/2011 Simmons ..... B67D 1/0054 62/389
8,584,897 B2 * 11/2013 Belcham ..... B67D 1/0872 222/1
9,376,303 B2 6/2016 Chadwell et al.
2001/0000107 A1 4/2001 Simmons et al.
2007/0056985 A9 3/2007 Goepfert
2008/0178607 A1 7/2008 Schneller et al.
2011/0108240 A1 * 5/2011 Bax ..... B67D 1/06 165/104.19
2012/0279244 A1 11/2012 Cleland
2016/0265827 A1 9/2016 Cleland

OTHER PUBLICATIONS

International Search Report and Written Opinion, dated Nov. 1, 2018, PCT/US18/46180, PCT Application Claiming Priority to U.S. Appl. No. 15/983,293.

* cited by examiner

METHOD AND APPARATUS FOR A BEVERAGE DISPENSING SYSTEM

CROSS-REFERENCE TO RELATED APPLICATION

This present application claims all available benefit, under 35 U.S.C. § 119(e), of U.S. provisional patent application Ser. No. 62/551,611, which was filed Aug. 29, 2017. By this reference, the full disclosure of U.S. provisional patent application Ser. No. 62/551,611 is incorporated herein as though now set forth in its entirety.

BACKGROUND OF THE INVENTION

1. Field of the Invention

The present invention relates to the dispensing of a beverage, such as beer, and, more particularly, but not by way of limitation, to a beverage dispensing system that supplies a chilled beverage while remaining mobile.

2. Description of the Related Art

The delivery of a beverage such as beer often involves the use of a cart that is mobile while containing a complete beverage cooling and dispensing capability. Such a cart includes a dispensing tower disposed on a cabinet housing a beer keg fluidly connected with the dispensing tower. In order to maintain dispensed beer at a desired temperature, the cart typically includes a first refrigeration system that chills the cabinet and a second refrigeration system that interacts with a glycol chiller system utilized to chill beer flowing from the beer keg to the dispensing tower. The first refrigeration system maintains the cabinet and thus the beer keg at a first desired temperature, whereas the second refrigeration system chills a glycol/water mixture flowing through the glycol chiller system to a second desired temperature below the first desired temperature. Beer flowing from the beer keg to the dispensing tower interfaces with the glycol chiller system such that the chilled glycol/water mixture of the glycol chiller system absorbs heat from the beer resulting in the beer dispensed from the dispensing tower achieving a desired dispensing temperature. Although the cart delivers beer at a desired dispensing temperature, the inclusion of first and second refrigeration systems produces certain disadvantages. In particular, two separate refrigeration systems are duplicative of components which increases cart costs while also undesirably increasing cart weight and size.

Accordingly, a beverage dispensing system that delivers a beverage at a desired dispensing temperature using a single refrigeration system will improve over prior dispensers.

SUMMARY OF THE INVENTION

In accordance with the present invention, a beverage dispensing system includes a cabinet with a dispensing station and a refrigerated compartment adapted to receive therein a beverage source. The beverage dispensing system further includes a refrigeration system and a cooling fluid system disposed in the cabinet, a cooling system disposed in the refrigerated compartment of the cabinet, and a beverage fluid system disposed in the cooling fluid system between the h age source and the dispensing station. The beverage dispensing system even further includes a control system electrically connected with the refrigeration system, the cooling system, and the cooling fluid system.

The cooling fluid system is adapted to circulate cooling fluid through the refrigeration system, the cooling system, and the dispensing station. The control system controls the refrigeration system to maintain cooling fluid circulating therethrough below a predetermined temperature. The control system further controls the cooling fluid system to normally circulate cooling fluid through the dispensing station such that the dispensing station cools beverage dispensed therefrom. The control system still further controls the cooling fluid system to redirect cooling fluid circulation from the dispensing station to the cooling system whereby the cooling system maintains the refrigerated compartment below a predetermined temperature.

The control system in particular with respect to the refrigeration system monitors the cooling fluid within the cooling fluid system to determine a temperature thereof and then activates the refrigeration system when the temperature of the cooling fluid within the cooling fluid system is greater than or equal to an upper threshold cooling fluid temperature. The control system deactivates the refrigeration system then the temperature of the cooling fluid within the cooling fluid system is less than or equal to a lower threshold cooling fluid temperature.

The control system in particular with respect to the cooling system monitors the refrigerated compartment of the cabinet to determine a temperature thereof and activates the cooling system when the temperature of the refrigerated compartment is greater than or equal to an upper threshold refrigerated compartment temperature. The control system deactivates the cooling system when the temperature of the refrigerated compartment is less than or equal to a lower threshold refrigerated compartment temperature.

The cooling fluid system includes a cooling fluid reservoir, a pump, and a valve. The cooling fluid reservoir provides a source of cooling fluid and further includes an outlet and an inlet coupled with the dispensing station and the cooling system. The pump couples at an inlet with the outlet of the cooling fluid reservoir and at an outlet with the refrigeration system such that the pump circulates the cooling fluid through the cooling fluid system. The valve couples at an inlet with the refrigeration system and at a first outlet with the dispensing station and at a second outlet with the cooling system. When the valve is deactivated, its first outlet is open such that cooling fluid flows through the dispensing station prior to the cooling fluid returning to the cooling fluid reservoir and its second outlet is closed to prevent flow through the cooling system. Alternatively, when the valve is activated, its first outlet is closed to prevent flow through the dispensing station and its second outlet is open such that cooling fluid flows through the cooling system prior to the cooling fluid returning to the cooling fluid reservoir.

The refrigeration system includes a fluid heat exchanger coupled at an inlet with the pump and at an outlet with the inlet of the valve. In the preferred embodiment, the refrigeration system operates according to a refrigeration cycle whereby a refrigerant circulating therethrough removes heat from cooling fluid traversing the fluid heat exchanger prior to the cooling fluid flowing to the valve.

The control system in order to control the refrigeration system polls a temperature sensor disposed in the cooling fluid reservoir to monitor the cooling fluid within the cooling fluid reservoir and determine a temperature thereof. When the temperature of the cooling fluid within the cooling fluid system is greater than or equal to an upper threshold cooling fluid temperature, the control system activates the refrigeration system whereby the refrigeration system cools the cooling fluid circulated through its fluid heat exchanger by the pump of the cooling fluid system. The control system deactivates the refrigeration system when the temperature of the cooling fluid within the cooling fluid system is less than or equal to a lower threshold cooling fluid temperature.

The beverage fluid system is disposed in the cooling fluid system between the beverage source and the dispensing station such that the cooling fluid system cools beverage flowing through the beverage fluid system prior to delivery of beverage to the dispensing station for dispensing therefrom. The beverage fluid system includes a beverage heat exchanger disposed in the cooling fluid reservoir. The beverage heat exchanger couples at an inlet with an outlet of the beverage source and at an outlet with the dispensing station. The cooling fluid within the cooling fluid reservoir absorbs heat from beverage flowing through the beverage heat exchanger from the beverage source prior to the beverage flowing from the beverage heat exchanger to the dispensing station.

The dispensing station includes a housing supporting a dispensing valve adapted to dispense beverage therefrom, a beverage line disposed in the housing, and a cooling fluid line disposed in the housing proximate the beverage line. The beverage line couples at an inlet with the outlet of the beverage heat exchanger and at an outlet with an inlet of the dispensing valve. The cooling fluid line couples at an inlet with the first outlet of the valve and at an outlet with the inlet of the cooling fluid reservoir. As such, when the valve is deactivated and its first outlet is open, cooling fluid flowing through the cooling fluid line absorbs heat from beverage in the beverage line prior to the cooling fluid returning to the cooling fluid reservoir.

The cooling system includes a refrigeration heat exchanger coupled at an inlet with the second outlet of the valve and at an outlet with the inlet of the cooling fluid reservoir. When the valve is activated and its second outlet is open, cooling fluid flowing through the refrigeration heat exchanger absorbs heat from the refrigerated compartment prior to the cooling fluid returning to the cooling fluid reservoir. The cooling system further includes a fan residing adjacent the refrigeration heat exchanger whereby the fan aids in transferring heat from the refrigerated compartment to the cooling fluid flowing through the refrigeration heat exchanger.

The control system in order to control the cooling system polls a temperature sensor disposed in the refrigerated compartment of the cabinet to monitor and determine a temperature thereof. The control system activates the valve when the temperature of the refrigerated compartment is greater than or equal to an upper threshold refrigerated compartment temperature. The valve accordingly closes its first outlet to prevent flow through the dispensing station and opens its second outlet such that cooling fluid flows through the refrigeration heat exchanger thereby absorbing heat from the refrigerated compartment prior to the cooling fluid returning to the cooling fluid reservoir. The control system further activates the fan such that the fan aids in transferring heat from the refrigerated compartment to the cooling fluid flowing through the refrigeration heat exchanger. The control system deactivates the valve when the temperature of the refrigerated compartment is less than or equal to a lower threshold refrigerated compartment temperature. The valve accordingly opens its first outlet such that cooling fluid flows through the dispensing station prior to the cooling fluid returning to the cooling fluid reservoir and closes its second outlet such that cooling fluid ceases flowing through the refrigeration heat exchanger. The control system further deactivates the fan.

In a method for dispensing beverages from a beverage dispensing system, a cooling fluid circulates through a refrigeration system whereby the refrigeration system maintains cooling fluid circulating therethrough below a predetermined temperature. In particular, the circulating cooling fluid is monitored to determine a temperature thereof. The refrigeration system is activated when the temperature of the cooling fluid is greater than or equal to an upper predetermined temperature, such that the refrigeration system cools the cooling fluid circulated therethrough, and the refrigeration system is deactivated when the temperature of the circulating cooling fluid is less than or equal to a lower predetermined temperature. The cooling fluid normally circulates through a dispensing station such that the dispensing station cools beverage delivered thereto from a beverage source. A refrigerated compartment having the beverage source disposed therein is monitored to determine a temperature thereof. The circulating cooling fluid is directed from the dispensing station to a cooling system when the temperature of the refrigerated compartment is greater than or equal to an upper predetermined temperature whereby the cooling system cools the refrigerated compartment. The circulating cooling fluid is directed from the cooling system to the dispensing station when the temperature of the refrigerated compartment is less than or equal to a lower predetermined temperature. The dispensing station is operated to dispense beverage therefrom.

DETAILED DESCRIPTION OF THE PREFERRED EMBODIMENT

Figure 1:
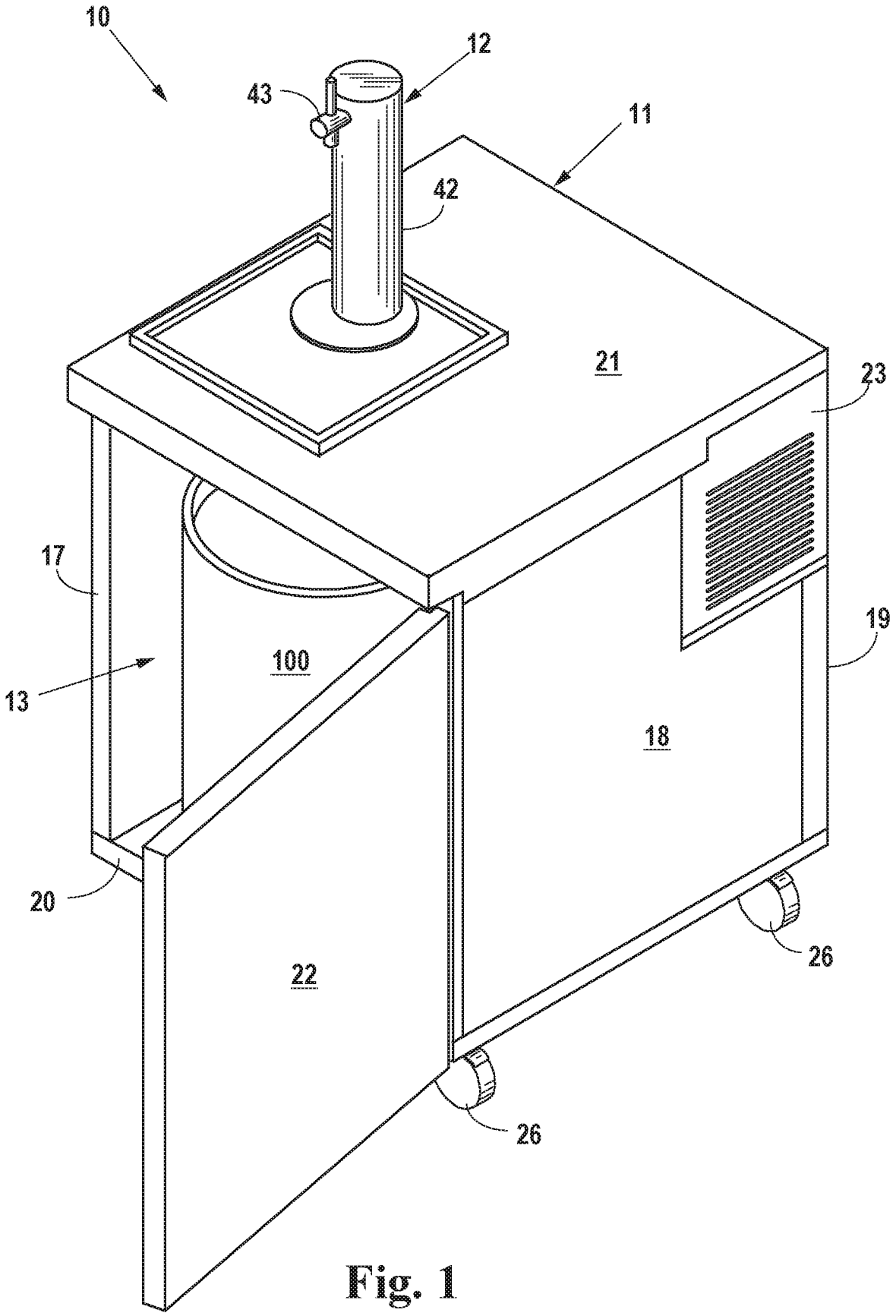
FIG. 1 is an isometric view illustrating a beverage dispensing system according to the preferred embodiment.
Figure 2:
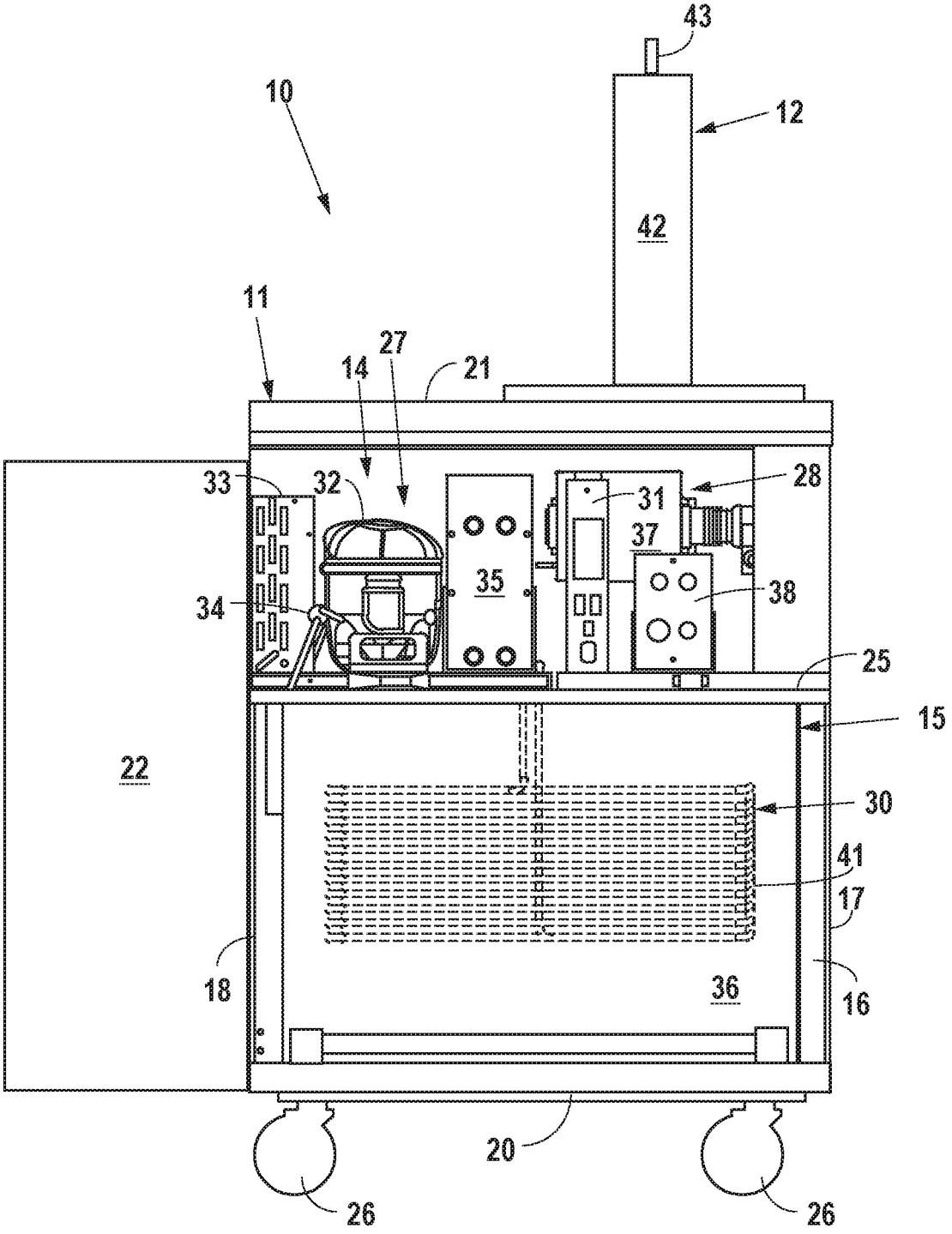
FIG. 2 is a rear elevation view illustrating the beverage dispensing system according to the preferred embodiment.
Figure 3:
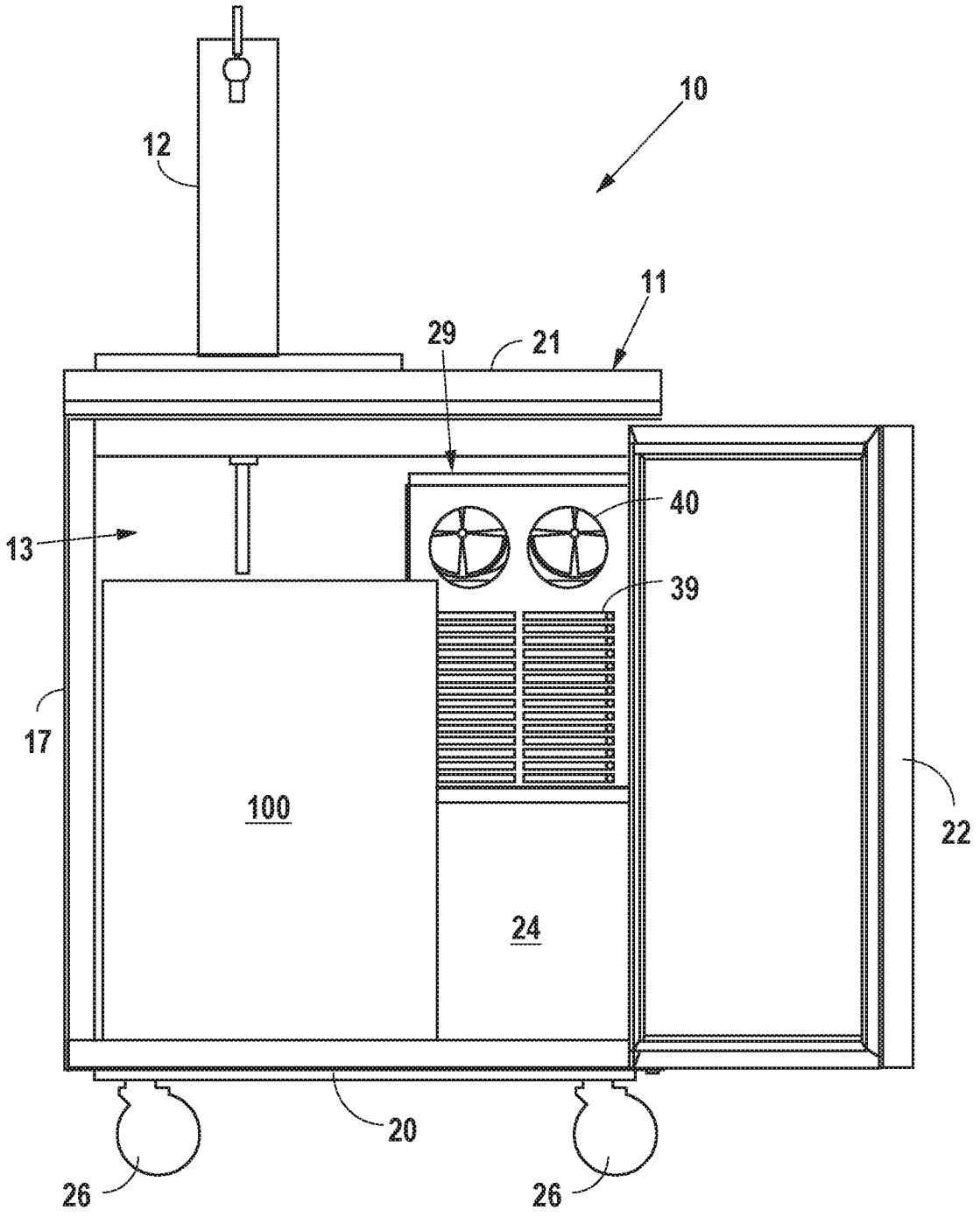
FIG. 3 is a front elevation view illustrating the beverage dispensing system according to the preferred embodiment.
Figure 4:
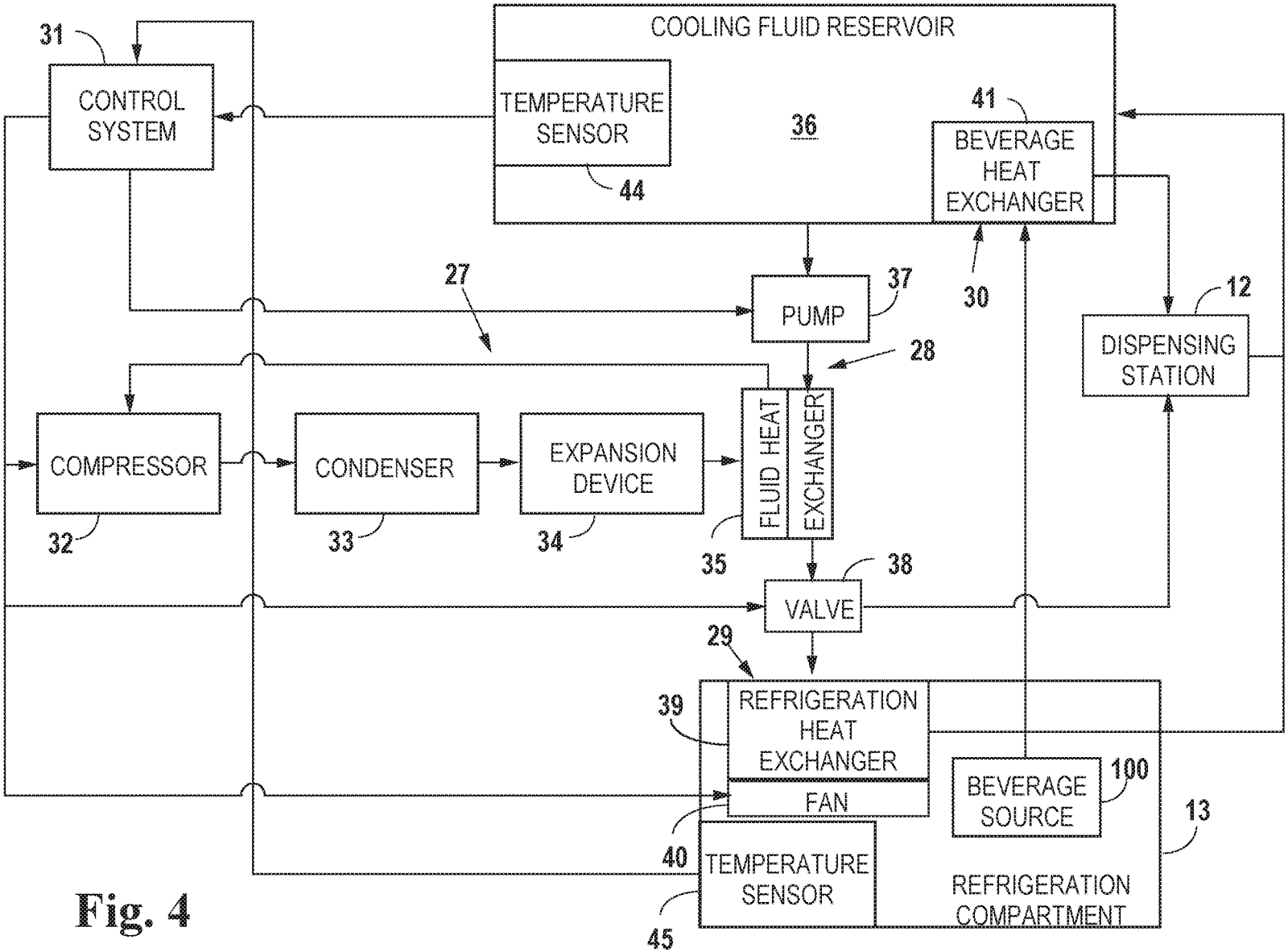
FIG. 4 is schematic diagram illustrating the beverage dispensing system according to the preferred embodiment.

As required, detailed embodiments of the present invention are disclosed herein; however, it is to be understood that the disclosed embodiments are merely exemplary of the invention, which may be embodied in various forms. Figures are not necessarily to scale, and some features may be exaggerated to show details of particular components or steps.

The present invention illustrated in the Figures and set forth in the following preferred embodiment is a beverage dispensing system 10 for beverages such as beer. Referring to FIGS. 1-4, the beverage dispensing system 10 includes a cabinet 11 incorporating a dispensing station 12, which, in the preferred embodiment, is a dispensing tower. The cabinet 11 in the preferred embodiment includes wheels 26 such that the cabinet 11 is mobile. The cabinet 11 includes a frame 16 supporting exterior side walls 17 and 18, a rear wall 19, a bottom 20, a top 21, and a door 22. The cabinet 11 includes an interior wall 24 and a platform 25 dividing the cabinet 11 into a refrigerated compartment 13 accessible through the door 22 and including a space that receives therein a beverage source 100 such as a beer keg, a component compartment 14, and a reservoir compartment 15. The exterior side wall 18 includes an opening covered by a screen 23 such that the component compartment 14 communicates exterior to the cabinet 11.

The beverage dispensing system 10 includes disposed in the cabinet 11 *a* refrigeration system 27, a cooling fluid system 28, a cooling system 29, a beverage fluid system 30, and a control system 31. The refrigeration system 27 interacts with the cooling fluid system 28 in order to cool a cooling fluid circulating through the cooling fluid system 28. The cooling fluid system 28 interacts with the cooling system 29 to impart cooling thereto and the beverage fluid system 30 in order to cool a beverage flowing through the beverage fluid system 30. The control system 31 controls the operations of the refrigeration system 27, the cooling fluid system 28, and the cooling system 29.

The refrigeration system 27 in the preferred embodiment includes a compressor 32, a condenser 33, an expansion device 34, and a fluid heat exchanger 35, all of which are located in the component compartment 14 of the cabinet 11. The refrigeration system 27 operates according to a refrigeration cycle whereby a circulating refrigerant removes heat from a cooling fluid circulating through the cooling fluid system 28 and transfers the removed heat external to the cabinet 11. The compressor 32 compresses the refrigerant prior to delivering the refrigerant to the condenser 33. The condenser 33 condenses the refrigerant resulting in the release of heat stored therein prior to the condenser 33 delivering the refrigerant to the expansion device 34. The condenser 33 resides adjacent the opening in the exterior side wall 18 covered by a screen 23 and may include a fan that aids in transferring heat released from the condensed refrigerant exterior to the cabinet 1. The expansion device 34 expands the refrigerant prior to delivering the refrigerant to the fluid heat exchanger 35. The fluid heat exchanger 35 evaporates the refrigerant resulting in the refrigerant absorbing heat from a cooling fluid circulating through the cooling fluid system 28 prior to the fluid heat exchanger 35 delivering the refrigerant to the compressor 32 for a repeat of the refrigeration cycle. The fluid heat exchanger 35 in the preferred embodiment is an evaporator including a refrigerant evaporator coil that evaporates refrigerant flowing therethrough and a cooling fluid coil proximate to or in direct contact with the refrigerant evaporator coil whereby refrigerant in the refrigerant evaporator coil absorbs heat from cooling fluid flowing through the cooling fluid coil.

The cooling fluid system 28 in the preferred embodiment includes a cooling fluid reservoir 36 located in the reservoir compartment 15 of the cabinet 11 that provides a source of cooling fluid, which, in the preferred embodiment, is a glycol/water mixture. The cooling fluid system 28 in the preferred embodiment further includes a pump 37 located in the component compartment 14 of the cabinet 11 that circulates the cooling fluid through the cooling fluid system 28. The cooling fluid system 28 in the preferred embodiment still further includes a valve 38 located in the component compartment 14 of the cabinet 11. The pump 37 via cooling fluid lines connects at an inlet with the cooling fluid reservoir 36 and at an outlet with a cooling fluid inlet of the fluid heat exchanger 35 to deliver cooling fluid thereto. The valve 38 via cooling fluid lines connects at an inlet with a cooling fluid outlet of the fluid heat exchanger 35 and at a first outlet with the dispensing station 12 and at a second outlet with the cooling system 29 to deliver cooling fluid thereto. The valve 38 in the preferred embodiment is a three-way valve whereby, when the valve 38 is deactivated, its first outlet is open such that cooling fluid flows to the dispensing station 12 while its second outlet is closed, and, when the valve 38 is activated, its first outlet is closed while its second outlet is open such that cooling fluid flows to the cooling system 29. The cooling system 29 and the dispensing station 12 via fluid lines return the cooling fluid to the cooling fluid reservoir 36.

The cooling system 29 resides in the refrigerated compartment 13 to impart cooling thereto whereby the refrigerated compartment 13 cools a beverage contained in a beverage source 100 disposed in the refrigerated compartment 13. The cooling system 29 in the preferred embodiment includes a refrigeration heat exchanger 39 and a fan 40 located in the refrigerated compartment 13. The refrigeration heat exchanger 39 via cooling fluid lines connects at an inlet with the second outlet of the valve 38 and at an outlet with the cooling fluid reservoir 36 such that cooling fluid flowing through the cooling fluid system 28 absorbs heat from the refrigerated compartment 13. The fan 40 resides adjacent the refrigeration heat exchanger 39 to aid in transferring heat from the refrigerated compartment 13 to the cooling fluid flowing through the refrigeration heat exchanger 39. In particular, the fan draws air from within the refrigerated compartment 13 and blows the air across the refrigeration heat exchanger 39 prior to the air returning to the refrigerated compartment 13 whereby the cooling fluid flowing through the refrigeration heat exchanger 39 absorbs heat from the air. The refrigeration heat exchanger 39 in the preferred embodiment is a coil over which air from the refrigerated compartment 13 is blown prior to its return to the refrigerated compartment 13 at a reduced temperature. The cooling system 29 accordingly reduces the temperature of the refrigerated compartment 13 such that a beverage source 100 disposed therein is maintained at a desired reduced temperature.

The beverage fluid system 30 resides in the cooling fluid reservoir 36 such that the cooling fluid in the cooling fluid reservoir 36 imparts cooling to a beverage flowing through the beverage fluid system 30. The beverage fluid system 30 in the preferred embodiment includes a beverage heat exchanger 41 located in the cooling fluid reservoir 36. The beverage heat exchanger 41 via beverage lines connects at an inlet with an outlet of the beverage source 100 and at an outlet with the dispensing station 12 such that beverage from the beverage source 100 flows through the beverage heat exchanger 41 and to the dispensing station 12. As beverage from the beverage source 100 flows through the beverage heat exchanger 41 and to the dispensing station 12, the lower temperature cooling fluid contained in the cooling fluid reservoir 36 absorbs heat from the beverage prior to its delivery at a reduced temperature to the dispensing station 12. The beverage heat exchanger 41 in the preferred embodiment is a coil immersed in the cooling fluid contained in the cooling fluid reservoir 36 whereby the cooling fluid absorbs heat from the beverage to ensure the beverage is delivered at a desired reduced temperature to the dispensing station 12.

The dispensing station 12 of the cabinet 11 receives beverage from the beverage fluid system 30 and delivers the beverage to a beverage container, typically a cup or mug. The dispensing station 12 of the cabinet 11 in the preferred embodiment includes a housing 42 supporting a user activated dispensing valve 43. The housing 42 includes a beverage line connected at an inlet with the beverage line from the beverage heat exchanger 41 of the beverage fluid system 30 and at an outlet with an inlet of the dispensing valve 43. The housing 42 further includes a cooling fluid line connected at an inlet with the cooling fluid line from the first outlet for the valve 38 of the cooling fluid system 28 and at an outlet with a cooling fluid line connected with the cooling fluid reservoir 36 of the cooling fluid system 28 to deliver cooling fluid thereto. The cooling fluid line of the housing 42 resides proximate to or in direct contact with the beverage line of the housing 42 such that lower temperature cooling fluid flowing through the cooling fluid line absorbs heat from beverage in the beverage line prior to its delivery from the dispensing valve 43 at a reduced temperature. The dispensing valve 43 in the preferred embodiment includes any suitable dispensing valve such a faucet or a tap.

The control system 31 electrically connects and communicates with the refrigeration system 27, the cooling fluid system 28, and the cooling system 29. In particular, the control system 31 electrically connects at least with the compressor 32 of the refrigeration system 27 and controls the operation thereof in order to activate and deactivate the refrigeration system 31. The control system 31 may also electrically connect with a fan of the condenser 33 to control the operation thereof. The control system 31 electrically connects with the pump 37 and the valve 38 of the cooling fluid system 28 and controls the operation thereof in order to regulate the cooling fluid system 28. The control system 31 electrically connects with and monitors a temperature sensor 44 disposed in the cooling fluid reservoir 36 of the cooling fluid system 28. The temperature sensor 44 is any type of known temperature sensor suitable to measure the temperature of the cooling fluid in the cooling fluid reservoir 36 and output a signal representative thereof to the control system 31. The control system 31 electrically connects with the fan 40 of the cooling system 29 and controls the operation thereof in order to regulate the cooling system 29. The control system 31 electrically connects with and monitors a temperature sensor 45 disposed in the refrigerated compartment 13. The temperature sensor 45 is any type of known temperature sensor suitable to measure the temperature of the refrigerated compartment 13 and output a signal representative thereof to the control system 31. The control system 31 in the preferred embodiment may be any type of computer, microcontroller, CPU, microprocessor, and the like suitable to control the beverage dispensing system 10.

Figure 5:
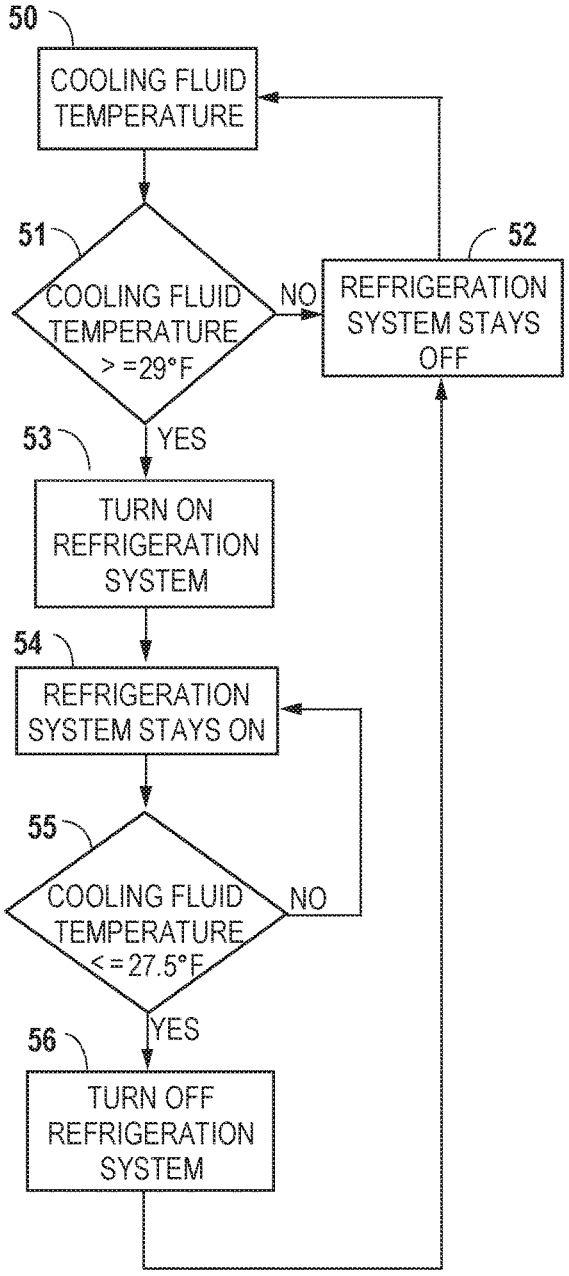
FIGS. 5 and 6 are flow charts illustrating control sequences for the beverage dispensing system according to the preferred embodiment.
Figure 6:
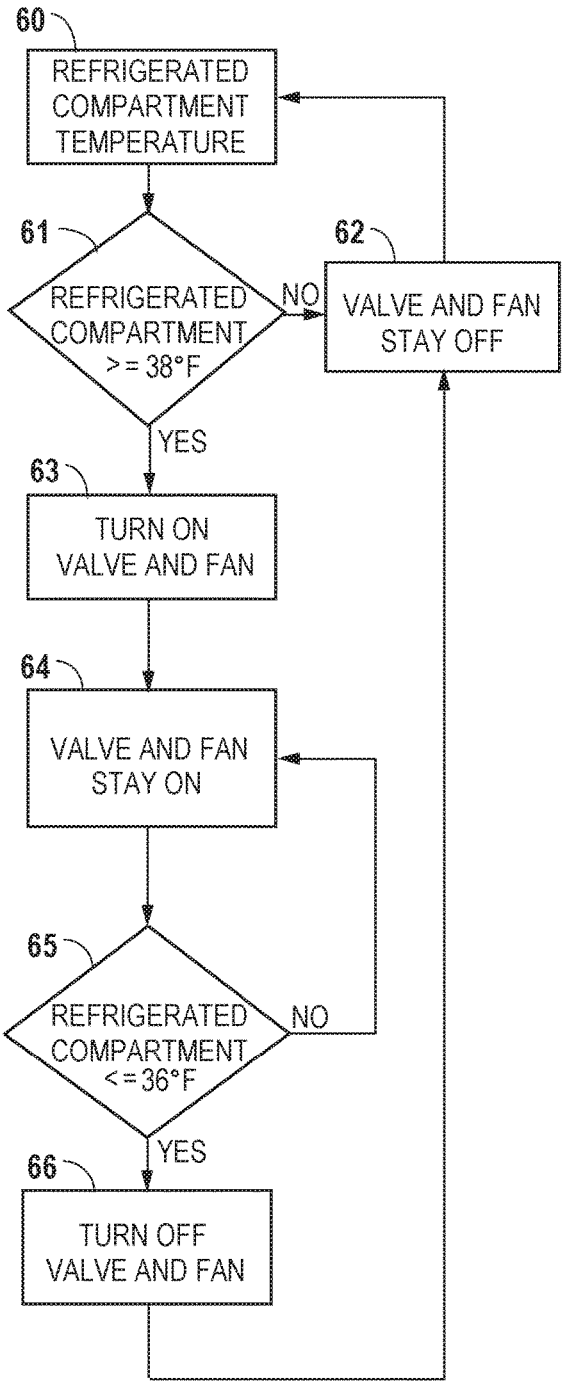

FIGS. 5 and 6 illustrate the operational steps performed by the control system 31 in controlling the beverage dispensing system 10. In the preferred embodiment, the control system 31, upon the powering of the beverage dispensing system 10, activates the pump 37 of the cooling fluid system 28, which remains on during the operation of the beverage dispensing system 10. The pump 37 pumps the cooling fluid from the cooling fluid reservoir 36 through the fluid heat exchanger 35 of the refrigeration system 37 and to the inlet of the valve 38. The control system 31 normally maintains the valve 38 deactivated such that the pump 37 pumps cooling fluid from the first outlet of the valve 38 through the dispensing station 12 and back to the cooling fluid reservoir 36. The pump 37 accordingly normally circulates the cooling fluid in a continuous loop from the cooling fluid reservoir 36 through the fluid heat exchanger 35, the valve 38 at its first outlet, and the dispensing station 12 prior to delivering the cooling fluid back to the cooling fluid reservoir 36. Although the pump 37 remains on continuously during the operation of the beverage dispensing system 10, one of ordinary skill in the art will recognize that the control system 31 may control the pump 31 intermittently to circulate the cooling fluid through the beverage dispensing system 10.

Referring to FIG. 5, the control system 31 in step 50 polls the temperature sensor 44 and receives a signal therefrom indicating the temperature of the cooling fluid within the cooling fluid reservoir 36. After receiving the cooling fluid temperature signal, the control system 31 proceeds to step 51 and determines whether the cooling fluid temperature is greater than or equal to an upper threshold cooling fluid temperature, which is 29° F. in the preferred embodiment. When the control system 31 determines the temperature of the cooling fluid is less than the upper threshold cooling fluid temperature, the control system 31 advances to step 52 and maintains the refrigeration system 27 deactivated. Alternatively, when the control system 31 determines the temperature of the cooling fluid is greater an or equal to the upper threshold cooling fluid temperature, the control system 31 advances to step 53 and activates the refrigeration system 27. With the refrigeration system 27 activated, its fluid heat exchanger 35 operates such that the refrigerant flowing therethrough absorbs heat from the cooling fluid also flowing therethrough. The cooled cooling fluid ultimately returns to the cooling fluid reservoir 36 resulting in the reduction in the temperature of the cooling fluid within the cooling fluid reservoir 36. The control system 31 continues to step 54 and maintains the refrigeration system 27 activated prior to progresses to step 55 where the control system 31 determines whether the cooling fluid temperature is less than or equal to a lower threshold cooling fluid temperature, which is 27° F. in the preferred embodiment. When the control system 31 determines the temperature of the cooling fluid is greater than the lower threshold cooling fluid temperature, the control system 31 returns to step 54 and maintains the refrigeration system 27 activated. Alternatively, when the control system 31 determines the temperature of the cooling fluid is less than or equal to the lower threshold cooling fluid temperature, the control system 31 proceeds to step 56 and deactivates the refrigeration system 27. The control system 31 returns to step 52 and maintains the refrigeration system 27 deactivated prior to re-executing step 50.

Referring to FIG. 6, the control system 31 in step 60 polls the temperature sensor 45 and receives a signal therefrom indicating the temperature of the refrigerated compartment 13. After receiving the refrigerated compartment temperature signal, the control system 31 proceeds to step 61 and determines whether the temperature of the refrigerated compartment 13 is greater than or equal to an upper threshold refrigerated compartment temperature, which is 38° F. in the preferred embodiment. When the control system 31 determines the temperature of the refrigerated compartment 13 is less than the upper threshold refrigerated compartment temperature, the control system 31 advances to step 62 and maintains the valve 38 of the cooling fluid system 28 and the fan 40 of the cooling system 29 deactivated. Alternatively, when the control system 31 determines the temperature of the refrigerated compartment is greater than or equal to the upper threshold refrigerated compartment temperature, the control system 31 advances to step 63 and activates the valve 38 of the cooling fluid system 28 and the fan 40 of the cooling system 29. With the valve 38 activated, its first outlet closes while its second outlet opens such that cooling fluid flow diverts from the dispensing station 12 to the refrigeration heat exchanger 39 of the cooling system 29 prior to the cooling fluid ultimately returning to the cooling fluid reservoir 36. The cooling fluid flows through the refrigeration heat exchanger 39 where the activated fan 40 moves air from the refrigerated compartment 13 across the refrigeration heat exchanger 39 before returning the air to the refrigerated compartment 13 whereby the cooling fluid flowing through the refrigeration heat exchanger 39 absorbs heat from the air. The control system 31 continues to step 64 and maintains the valve 38 and the fan 40 activated prior to progresses to step 65 where the control system 31 determines whether the temperature of the refrigerated compartment 13 is less than or equal to a lower threshold refrigerated compartment temperature, which is 36° F. in the preferred embodiment. When the control system 31 determines the temperature of the refrigerated compartment 13 is greater than the lower threshold refrigerated compartment temperature, the control system 31 returns to step 64 and maintains the valve 38 and the fan 40 activated. Alternatively, when the control system 31 determines the temperature of the refrigerated compartment 13 is less than or equal to the lower threshold refrigerated compartment temperature, the control system 31 proceeds to step 56 and deactivates the valve 38 and the fan 40. Upon the deactivation of the valve 38, its second outlet closes while its first outlet opens such that cooling fluid flow diverts from the refrigeration heat exchanger 39 of the cooling system 29 to the dispensing station 12 to prior to the cooling fluid ultimately returning to the cooling fluid reservoir 36. The control system 31 returns to step 62 and maintains the valve 38 and the fan 40 deactivated prior to re-executing step 60.

A user dispenses a beverage from the beverage dispensing system 10 by activating the dispensing valve 43 to initiate beverage flow therefrom into a container therebelow. Upon activation of the dispensing valve 43, beverage flows from the beverage source 100 through the beverage fluid system 30, which further cools the beverage, and to the dispensing valve 43 for dispensing therefrom. The flow of beverage ceases after the user deactivates the dispensing valve 43.

The control system 31 controls the cooling fluid system 28 to normally circulate the cooling fluid to the dispensing station 12 whereby the cooling fluid flowing through the cooling fluid line of the dispensing station 12 absorbs heat from the beverage flowing through the beverage line of the dispensing station 12. This particularly removes heat from beverage contained in the beverage line prior to the activation of the dispensing valve 43 such that the dispensed beverage enters a container at a desired reduced dispensing temperature. The control system 31, when necessary to maintain the refrigerated compartment 13 at its desired reduced temperature, controls the cooling fluid system 28 to redirect the cooling fluid through the cooling system 29 in order for the cooling system 29 to remove heat from the refrigerated compartment 13. The control system 31, through its periodic activation of the refrigeration system 27, ensures the cooling fluid in the cooling fluid reservoir 36 and thus the cooling fluid circulating through the cooling fluid system 28 remains at a desired reduced temperature necessary for correct operation of the cooling system 29 and the dispensing station 12. Although the control system 31 alternately delivers the cooling fluid to the dispensing station 12 and the cooling system 29, one of ordinary skill in the art will recognize that the cooling fluid system 28 may be configured to deliver cooling fluid simultaneously to the dispensing station 12 and the cooling system 29.

The configuration of the cooling fluid system 28 to deliver a cooling fluid to both the dispensing station 12 and the cooling system 29 improves the beverage dispensing system 10. The single cooling fluid system 28 that cools the dispensing station 12 and the cooling system 29 permits the beverage dispensing system 10 to incorporate a single refrigeration system 27, which eliminates duplicative components thereby reducing the cost, size and weight of the beverage dispensing system 10.

Although the present invention has been described in terms of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims that follow.

The invention claimed is:

1. A beverage dispensing system, comprising:

a cabinet including a dispensing station and a refrigerated compartment adapted to receive therein a beverage source;

a refrigeration system disposed in the cabinet;

a cooling system disposed in the refrigerated compartment of the cabinet;

a cooling fluid system disposed in the cabinet, the cooling fluid system, comprising:

a cooling fluid reservoir providing a source of a cooling fluid, a pump coupled with the cooling fluid reservoir to receive the cooling fluid from the cooling fluid reservoir and with the refrigeration system to deliver the cooling fluid through the refrigeration system, and a valve coupled with the refrigeration system to receive the cooling fluid from the refrigeration system, the valve coupled with the dispensing station and with the cooling system, whereby, when the valve is deactivated, the valve permits flow of the cooling fluid through the dispensing station prior to the cooling fluid returning to the cooling fluid reservoir while the valve prevents flow of the cooling fluid through the cooling system, further whereby, when the valve is activated, the valve prevents flow through the dispensing station while the valve permits flow of the cooling fluid through the cooling system prior to the cooling fluid returning to the cooling fluid reservoir;

a control system electrically connected with the refrigeration system, the cooling system, and the cooling fluid system, wherein the control system is configured to:

normally maintains the valve deactivated whereby the pump circulates the cooling fluid through the dispensing station, monitors the refrigerated compartment of the cabinet to determine a temperature of the refrigerated compartment, activates the valve when the temperature of the refrigerated compartment is greater than or equal to an upper threshold refrigerated compartment temperature, whereby the pump circulates the cooling fluid through the cooling system, and deactivates the valve when the temperature of the refrigerated compartment is less than or equal to a lower threshold refrigerated compartment temperature; and a beverage fluid system disposed in the cooling fluid system between the beverage source and the dispensing station, wherein the cooling fluid system cools beverage flowing through the beverage fluid system prior to delivery of beverage to the dispensing station for dispensing therefrom.

2. The beverage dispensing system according to claim 1, wherein the control system:

monitors the cooling fluid within the cooling fluid system to determine a temperature of the cooling fluid;

activates the refrigeration system when the temperature of the cooling fluid within the cooling fluid system is greater than or equal to an upper threshold cooling fluid temperature, whereby the refrigeration system cools the cooling fluid circulated therethrough by the cooling fluid system; and deactivates the refrigeration system when the temperature of the cooling fluid within the cooling fluid system is less than or equal to a lower threshold cooling fluid temperature.

3. The beverage dispensing system according to claim 1, wherein the control system:

activates the cooling system when the temperature of the refrigerated compartment is greater than or equal to an upper threshold refrigerated compartment temperature, whereby the cooling system cools the refrigerated compartment; and deactivates the cooling system when the temperature of the refrigerated compartment is less than or equal to a lower threshold refrigerated compartment temperature.

4. The beverage dispensing system according to claim 1, wherein the refrigeration system includes a fluid heat exchanger coupled with the pump to receive the cooling fluid from the pump and with the valve to deliver the cooling fluid to the valve, further wherein the refrigeration system operates according to a refrigeration cycle whereby a refrigerant circulating therethrough removes heat from the cooling fluid traversing the fluid heat exchanger prior to the cooling fluid flowing to the valve.

5. The beverage dispensing system according to claim 1, the beverage fluid system, comprising a beverage heat exchanger disposed in the cooling fluid reservoir, the beverage heat exchanger coupled with the beverage source to receive a beverage from the beverage source and with the dispensing station to deliver the beverage to the dispensing station, wherein the beverage flows from the beverage source through the beverage heat exchanger and to the dispensing station, further wherein the cooling fluid within the cooling fluid reservoir absorbs heat from the beverage flowing through the beverage heat exchanger.

6. The beverage dispensing system according to claim 5, the dispensing station, comprising:

a housing supporting a dispensing valve adapted to dispense beverage therefrom;

a beverage line disposed in the housing, the beverage line coupled with the beverage heat exchanger to receive the beverage from the beverage heat exchanger and with the dispensing valve to deliver the beverage to the dispensing valve; and a cooling fluid line disposed in the housing proximate the beverage line, the cooling fluid line coupled with the the valve to receive the cooling fluid from the valve and with the cooling fluid reservoir to deliver the cooling fluid to the cooling fluid reservoir such that, when the valve is deactivated, the pump circulates the cooling fluid through the cooling fluid line, whereby the cooling fluid line absorbs heat from the beverage in the beverage line prior to the cooling fluid returning to the cooling fluid reservoir.

7. The beverage dispensing system according to claim 1, the cooling system, comprising:

a refrigeration heat exchanger coupled with the valve to receive the cooling fluid from the valve and with the the cooling fluid reservoir to deliver the cooling fluid to the cooling fluid reservoir such that, when the valve is activated, the pump circulates the cooling fluid through the refrigeration heat exchanger, whereby the refrigeration heat exchanger absorbs heat from the refrigerated compartment prior to the cooling fluid returning to the cooling fluid reservoir; and a fan residing adjacent the refrigeration heat exchanger whereby the fan aids in transferring heat from the refrigerated compartment to the cooling fluid flowing through the refrigeration heat exchanger.

8. The beverage dispensing system according to claim 4, wherein the control system:

polls a temperature sensor disposed in the cooling fluid reservoir to monitor the cooling fluid within the cooling fluid reservoir and determine a temperature of the cooling fluid;

activates the refrigeration system when the temperature of the cooling fluid within the cooling fluid system is greater than or equal to an upper threshold cooling fluid temperature, whereby the refrigeration system cools the cooling fluid circulated through the fluid heat exchanger by the pump of the cooling fluid system; and deactivates the refrigeration system when the temperature of the cooling fluid within the cooling fluid system is less than or equal to a lower threshold cooling fluid temperature.

9. The beverage dispensing system according to claim 7, wherein the control system:

polls a temperature sensor disposed in the refrigerated compartment of the cabinet to monitor and determine a temperature of of the refrigerated compartment;

activates the valve when the temperature of the refrigerated compartment is greater than or equal to an upper threshold refrigerated compartment temperature whereby the valve prevents flow of the cooling fluid through the dispensing station and the valve permits flow of the cooling fluid through the refrigeration heat exchanger thereby absorbing heat from the refrigerated compartment prior to the cooling fluid returning to the cooling fluid reservoir;

activates the fan such that the fan aids in transferring heat from the refrigerated compartment to the cooling fluid flowing through the refrigeration heat exchanger;

deactivates the valve when the temperature of the refrigerated compartment is less than or equal to a lower threshold refrigerated compartment temperature whereby the valve permits flow of the cooling fluid through the dispensing station prior to the cooling fluid returning to the cooling fluid reservoir and the valve prevents flow of the cooling fluid through the refrigeration heat exchanger; and deactivates the fan.

* * * * *